United States Patent [19]

Sato et al.

[11] 3,974,105

[45] Aug. 10, 1976

[54] OVERTEMPERATURE AND OVERCURRENT RESISTOR FUSE

[75] Inventors: Kunio Sato, Neyagawa; Tomio Ishida; Kanji Sugihara, both of Hirakata, all of Japan

[73] Assignee: Matsushita Electric Industrial Co., Ltd., Osaka, Japan

[22] Filed: May 29, 1974

[21] Appl. No.: 474,442

[30] Foreign Application Priority Data

May 30, 1973 Japan ..... 48-61312

[52] U.S. Cl. ..... 252/512; 252/500; 252/511; 338/25

[51] Int. Cl.[2] ..... H01B 1/02; H01C 1/02

[58] Field of Search ..... 252/500, 511, 512; 338/25

[56] References Cited

UNITED STATES PATENTS

| | | | |
|---|---|---|---|
| 3,351,882 | 11/1967 | Kohler | 338/25 |
| 3,673,121 | 1/1970 | Meyer | 252/511 |
| 3,745,507 | 1/1973 | Oshida et al. | 338/25 |

*Primary Examiner*—Leland A. Sebastian
*Assistant Examiner*—Josephine Lloyd
*Attorney, Agent, or Firm*—Wenderoth, Lind & Ponack

[57] ABSTRACT

An overtemperature and overcurrent resistor fuse has a resistor body with finely divided conducting powder and silica powder dispersed in an organic flux and resin. The conducting powder has a melting temperature in the range from 60°C to 350°C. This overtemperature and overcurrent resistor fuse has a relatively low electrical resistance below a selected melting temperature and has an irreversible abrupt increase of electrical resistance above the selected melting temperature range caused by serious overload or overheating conditions.

6 Claims, 11 Drawing Figures

OVERTEMPERATURE AND OVERCURRENT RESISTOR FUSE

BACKGROUND OF THE INVENTION

This invention relates to an overtemperature and overcurrent resistor fuse.

A conventional overtemperature and overcurrent resistor fuse comprises a resistor body having finely divided conducting powder, silica powder and an additive powder dispersed in resin, said additive powder having a transforming temperature in the range from Tg°C to (Tg°C+200°C), wherein Tg°C is the glass transition temperature of said resin. Such a resistor fuse is disclosed in U.S. Pat. No. 3,745,507. Such a resistor fuse, however, has the disadvantage that when it is operated under an overload condition such as a wattage of from 5 to 50 times the rated wattage, the resistor or fuse has a slow irreversible increase of electrical resistance. Moreover, when a current which produces a wattage larger than a wattage 50 times the rated wattage flows through the resistor fuse, it is rapidly heated by well known Joule-heating. Because of the heat, the resistance of the resistor fuse decreases. Because of this decrease of resistance, the current flowing through the resistor fuse increases, and so the resistor fuse is heated even more by Joule-heating. Due to this vicious circle, the resistor fuse is finally short-circuited, arcing occurs, or the resistor fuse burns or becomes charred or softened. Accordingly, there has been difficulty in providing a resistor fuse which is free from above mentioned disadvantage for a relatively low electrical resistance below 1Ω, even if the resistor fuse is operated under serious overload or overheating conditions.

SUMMARY OF THE INVENTION

An object of the invention is to provide an overtemperature and overcurrent resistor fuse which is free from arcing, burning, charring or mechanical damage and has an irreversible increase of specific resistivity from $10^{-2}$ Ω-cm to $10^{12}$ Ω-cm at a selected temperature value under serious overload or over-heating conditions.

Another object of the invention is to provide an overtemperature and overcurrent resistor fuse which has extermely high stability with respect to electrical resistance, particularly when operated in a normal condition for which the resistor is designed.

These objects are achieved by an overtemperature and overcurrent resistor fuse comprising a resistor body consisting essentially of finely divided conducting powder, silica powder and an organic flux powder dispersed in a resin, said resistor body having a threshold temperature above which the particles of said conductive powder are aggregated, due to melting, to plural bodies separately and insulatively dispersed in said resin. Since this is the temperature at which opening of the circuit in which the resistor is connected opens, this will hereinafter be called the opening temperature.

Further advantages of the present invention are that the resistor fuses of the present invention can be made extremely small; that the thermal capacity of the resistor fuses can be made very small, and the resistor fuses follow any increase of temperature, even a rapid increase, very closely; and that as a starting material for the conductive powder in the resistor body, metals and alloys in a body form can be used.

Details of the present invention will be apparent upon consideration of the following description taken together with the accompanying drawings.

Figure 1:
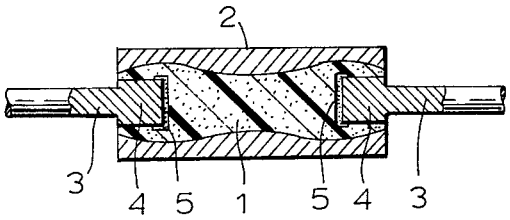
FIG. 1 is a cross sectional view of an overtemperature and overcurrent resistor fuse according to the present invention.
Figure 1B:
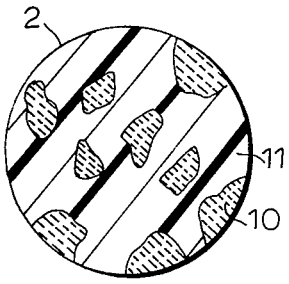
FIG. 1*b* is an enlarged sectional view of the material of the outer sleeve around the resistor body.
Figure 1A:
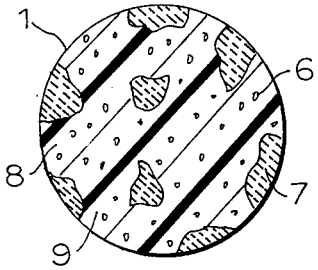
FIG. 1*a* is an enlarged sectional view of the material of the resistor body under normal temperature conditions.

Before proceeding with a detailed description of the invention, the construction of an overtemperature and overcurrent resistor fuse contemplated by this invention will be explained with reference to FIG. 1. Reference numeral 1 designates a resistor body having finely divided conductive powder 6 and particles of silica powder 7 dispersed in an organic flux 8 and a resin 9. The resistor body 1 can have any suitable shape, but FIG. 1 shows the case when the resistor body is substantially cylindrical in shape. A pair of solder coated electrodes 3 are embedded in the ends of the resistor fuse. Each of the electrodes 3 has a head part 4, on which, if desired, a colloidal graphite layer 5 is provided. This colloidal graphite layer 5, if provided, acts to improve the electrical contact between the electrode 3 and the resistor 1, and to prevent the corrosion of the surface of the electrode 3 on which the colloidal graphite layer 5 is applied. Reference numeral 2 designates an outer sleeve which includes finely divided particles of silica powder 10 dispersed in a further resin 11 and which can be used to envelop said resistor body 1. The conducting powder 6 dispersed in organic flux 8 and resin 9 preferably has a melting temperature in the range from 60°C to 350°C. The resistor fuse of the invention has an abrupt irreversible increase of specific resistivity from $10^{-2}$ Ω-cm to $10^{12}$ Ω-cm at the selected temperature value under serious overload or overheating conditions. This temperature at the irreversibly increasing point is defined as the opening temperatures of the resistor fuses. The resistor fuses, of course, have a positive resistance-temperature characteristic. However a more precise definition of the "opening temperature" will be given later. The phrase "an irreversible increase" means that the increased electrical resistance does not decrease even after the resistor body is cooled to the initial temperature such as room temperature.

The mechanism of the irreversible increase in the electrical resistance of the resistor body of the present invention is as follows.

Figure 2:
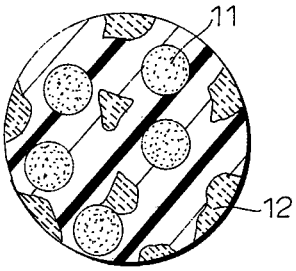
FIG. 2 is an enlarged sectional view of the resistor material of the overtemperature and overcurrent resistor fuse after it has been heated above the opening temperature of the resistor fuse.

The electrical conduction of the resistor body for an increase of temperature below a melting temperature of conductive powder is attributed to a chain of conduction paths along the particles of the conductive powder surrounded by the organic flux and resin. Accordingly, when operated at normal conditions for which the resistor fuses as resistors are designed, the resistor fuses have an extremely low electrical resistance. When overheating or an overload is applied to the resistor body of the resistor fuse, the resistor body is heated over above a critical temperature so that the conductive powder dispersed in the resistor body melts abruptly at the melting point temperature, and said organic flux and resin is softened so as to reduce the compressive force on the conductive powder. At this point, the organic flux provides tarnish-free surfaces of the conductive powder and keeps the surfaces in a clean state. Therefore, the particles of the melted conductive powder aggregate under the influence of surface-tension of the conductive powder, and the state of dispersion of conductive powder in the resistor body is changed, due to melting, to a state in which a plurality of bodies of aggregated conductive particles (e.g. of substantially spherical form) are separately dispersed the resin, i.e. aggregates of particles of the conductive powder are relatively widely separated from each other by the organic flux and resin as shown in FIG. 2. The bodies of aggregated particles have a size of e.g. 40 microns–1.5 mili meters. This mechanism is presumably the reason for the irreversible and abrupt increase in the electrical resistance of the resistor body.

Accordingly, the resistor fuse of the present invention may act as a form of "thermal limiter" which reduces the current flow through the short circuit load to a safe extremely low value when the resistor fuse is heated to the critical temperature range. Thus, expensive electrical equipment, as well as component parts, is protected from arcing, burning, charring or mechanical damage due to overheating, when there is an excessive rise in ambient temperature.

In making the resistor fuses according to the present invention, a mixture of finely divided conductive powder such as fusible metal and metal alloys, silica powder and any suitable flux powder in available resin is well mixed at a temperature of 50°C to 150°C by any suitable and available hot rolling method until it acquires the proper plasticity. The conductive powder can be any suitable metal or metal alloy. conductive powders are tin, lead, cadmium, bismuth, indium and fusible alloys thereof. The flux powder can be any suitable organic substance, Preferable flux powders are acids, halogens, amines, amides, and rosin base. In the examples which will be set forth later, stearic acid, behenic acid, glutamic hydrochloride, waterwhite rosin, and water-white rosin with activators are given as examples. The resin can be any suitable thermosetting binder such as phenol resin, urea resin, melamine resin, epoxy resin, unsaturated polyester resin, etc., and thermoplastic binder, such as polyethylene, polypropylene, polyvinylidene chloride, polyestyrene, acrylonitrilebutadiene-styrene resin, or natural or synthetic rubbers such as butadiene-styrene, butyl rubber, ethylene-propylene rubber, etc., and mixtures thereof.

The preferred composition of the mixture is from 30 to 90 weight % of conductive powder, from 0 to 60 weight % of silica powder, from 1 to 20 weight % of flux powder and the balance resin.

The preferred average particle size of said finely divided silica powder ranges from about 0.3 to 20 microns.

The preferred average particle size of said fusible metal or metal alloys as a starting material ranges from about 1 micron to 5 mm.

The average particle size referred to herein is determined by a well known electron microscope method described e.g. in a literature of J. Soc. chem. Ind. 62,374(1943); Nature, 17, 350(1953).

After being cooled to room temperature, the mixture is crushed and ground into granules as a starting material for the resistor body.

For the outer sleeve, a mixture of finely divided silica powder in a resin is well mixed at a temperature of 50°C to 150°C by any suitable and available hot rolling method unitl it acquires proper plasticity. An operable composition of the mixture is up to 80 weight % of silica powder, and the balance resin. After being cooled to room temperature, the mixture is crushed and ground into granules to form the starting material for the outer sleeve.

A unitary body having the resistor body enveloped by the outer sleeve is formed by any suitable and available method, for example, by an extrusion method or a pressing method. In an extrusion method, the aforesaid two mixtures in granule form are preheated and are simultaneously supplied to a nozzle for extrusion. The extruded body is in a long cylindrical form and is cut into many short cylinders having desired lengths. In a pressing method, the resistor body and the outer sleeve are seperately formed by pressing and then are combined together to form a short cylinder by any suitable method. The short cylinder is provided, at both ends, with two solder coated electrode leads having a thermal conductivity, preferably, of 0.1 to 0.4 cal/cm, sec. °C, by any suitable method. Preferably, the short cylinder is inserted in a molding die, heated to a temperature of 60° to 180°C and then is pressed by two punches having two solder coated electrode leads inserted therein. A pressing pressure, preferably, at 400 to 1000 kl per sq. cm. is applied for a time period of 20 to 180 seconds to embed the two electrode leads in the short cylinder. Preferred electrode leads are made of copper-chromium alloy, copper clad iron, brass, iron or bronze. If necessary, the finished resistor fuse is further heated at a temperture of 60°C to 170°C for 3 to 24 hours to obtain more stable electrical properties.

It has been discovered according to the present invention that when there is provided a resistor body consisting essentially of finely divided conductive powder, silica powder and an organic flux dispersed in a resin so as to have an opening temperature above which the resistor body consists essentially of bodies of aggregated particles of conductive material separately dispersed in the resin due to melting with the aid of the organic flux, the resultant resistor fuse is free from arcing, burning, charring or mechanical damage due to overheating or joule heating, and has an increase of irreversible electrical resistivity about from $10^{-2}\Omega$-cm to $10^{12}\Omega$-cm at the selected temperature. Preferably, said conductive powder, for example tin powder, has a high purity of 99.00 to 99.99 weight % of pure tin and the balance impurities. The melting temperature of the conductive powder such as tin powder is measured by using the differential thermal analyzing apparatus (RIKAGAKU Denki Co., Ltd: No. 8001) in advance of adding the conductive powder to the resistor body.

EXAMPLE 1.

Acetylene black, silver, tin-lead eutectic (40 percent tin, 60 percent lead), tin, bismuth and lead powder were used as conductive powders as shown in Table 1. Phenol resin was used as a binder. P-terphenyl powder was used as an additive powder to make a conventional resistor fuse. The finely divided silica powder which was used had an average particle size of 10 microns. A mixture of 20 to 90 weight % of conductive powder, 0 to 60 weight % of silica powder, 0 to 20 weight % of P-terphenyl powder and the balance phenol resin was prepared as shown in Table 2 and was mixed well at 80°C by a hot rolling machine. The mixture was cooled and crushed into granules having a particle size of 5 to 30 Mesh (about 3.96 mm to about 500 microns). Another mixture of granules of 80 weight % of silica powder and 20 weight % of phenol resin was prepared in a way similar to that described above. Both kinds of granules were charged into a conventional extrusion press to form plural short cylinders each having a resistor body enveloped by an outer sleeve. The nozzle part of the extrusion machine was heated to 100°C. Each of the short cylinders was provided at each end thereof with a solder coated electrode lead by a well known punching method operated at 160°C for 2 minutes at a pressure of 400 kg/cm$^2$. The short cylinders each having two solder coated electrode leads embedded in the ends thereof were heated at 100°C for 5 hours to form stable resistor fuses. The resultant resistor fuses (Type ¼ watt) had a nominal resistance value from $1.5\times10^{-3}\Omega$ to 3 $\Omega$ at room temperature. These resistors were tested in an opening temperature test and an aging test. The opening temperature test was carried out as follows. A thermometer was placed outside each of the resistor fuses, while an ohm-meter was connected to the leads as the ends of each resistor fuse. The resistance value of each resistor fuse was then measured while its temperature was varied from room temperature to 400°C by putting each resistor fuse in silicone oil the temperature of which was smoothly increased at a rate of temperature change of 1 °C/min., until the resistor fuse was opened completely i.e. its resistance increased greatly. The resistor fuse of this invention had an abrupt increase of electrical resistance at the melting temperature of the conductive powder during the increase in the heating temperature. The temperature at which the abrupt increase of resistance occurs is defined as the opening temperature of the resistor fuse.

Figure 3:
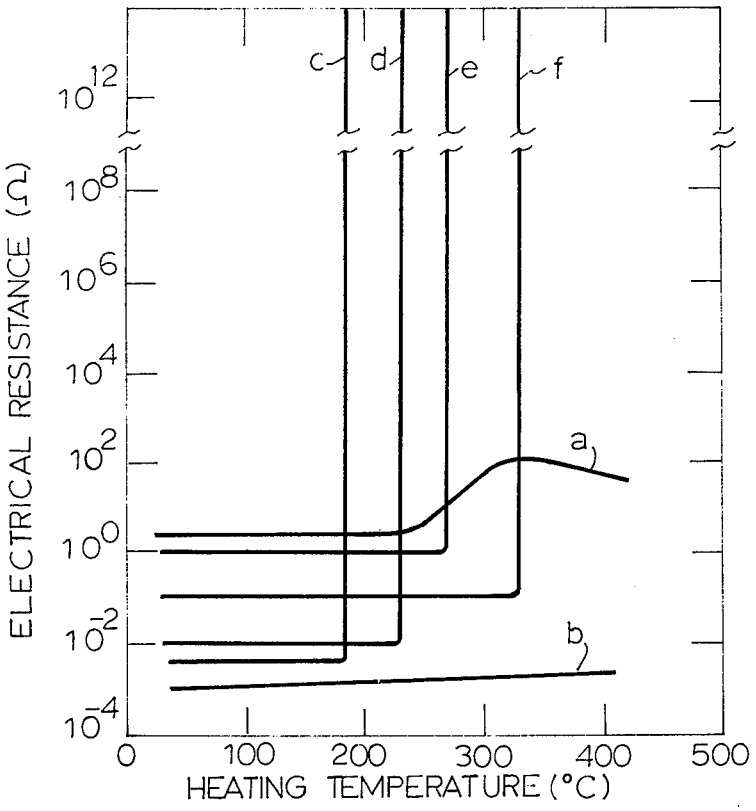
FIG. 3 is a graph illustrating the relationship between the heating temperature and the electrical resistance value of overtemperature and overcurrent resistor fuses of the present invention

FIG. 3 is a graph illustrating the relation between the heating temperature and the electrical resistance value of the resistor fuses based on the data obtained from the temperature test.

Aging tests were carried out at temperatures of 60°C, 100°C and 120°C for 1000 hours.

Figure 4:
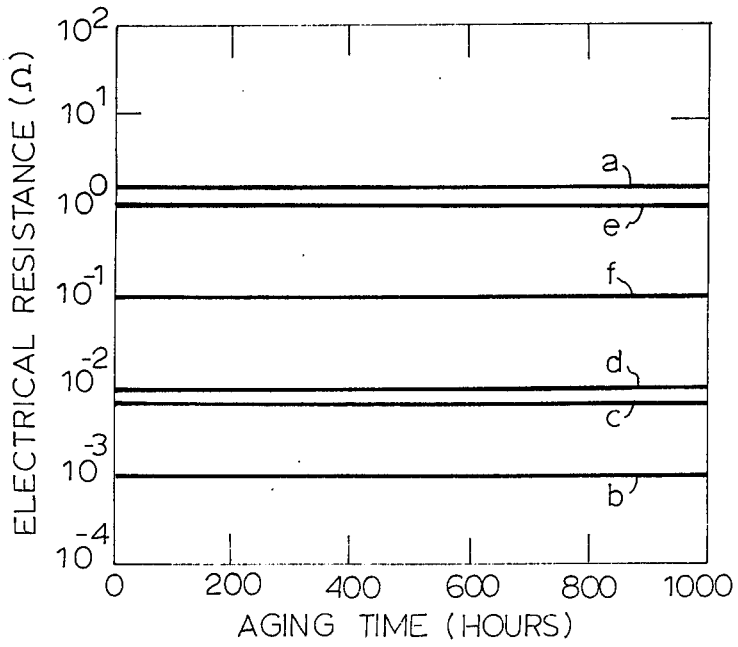
FIG. 4 is a graph illustrating the relation between aging time and the electrical resistance value of overtemperature and overcurrent resistor fuses of the present invention.

FIG. 4 is a graph illustrating the relation between aging time and the electrical resistance value of the resistor fuses based on data from the aging tests. As is apparent from FIG. 3 and Table 1, it is possible to determine the opening temperature of the resistor fuses by suitably selecting the melting temperature of conductive powder which is used. Good results can be obtained by using a conductive powder having a melting temperature in the range from 60°C to 350°C dispersed in a resin.

Furthermore, Furthermore, it is apparent from FIG. 4 that the resistor fuse of the present invention is about the same as a conventional resistor fuse and a well-known conductive plastic resistor with respect to the characteristics of the electrical resistance change vs. time for the resistor heated to a temperature below the melting temperature of the conductive powder.

EXAMPLE 2

Low-temperature solder containing cadmium was used as a conductive powder. The lead-tin-cadmium eutectic (32 percent lead, 50 percent tin, 18 percent cadmium) had a melting temperature of 143°C. The conductive powder used had a particle size which enabled it to pass through a 300 mesh screen (about 50 microns). The silica powder used had an average particle size of 10 microns. The resins used were thermosetting such as phenol resin and epoxy resin containing a hardener, thermoplastic such as epoxy resin only (D.E.R. 664, D.E.R. 669) and polystyrene as listed in Table 3.

Figure 5:
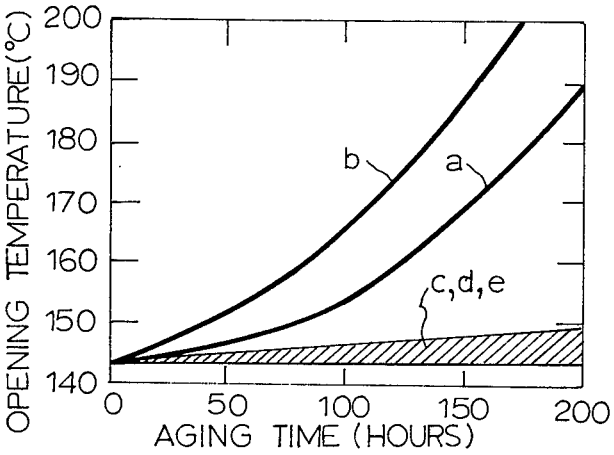
FIG. 5 is a graph illustrating the relation between the aging time and opening temperature of overtemperature and overcurrent resistor fuses of the present invention.

Five kinds of resistor fuses were prepared from these mixtures in a manner similar to that of Example 1. The resultant resistor fuses (Type ¼ watt) had a nominal resistance value from $3.0\times10^{-2}\Omega$ to $7.0\times10^{-2}\Omega$ at room temperature. These resistor fuses were tested in an opening temperature test. FIG. 5 is a graph illustrating the relation between the aging time at a temperature of 100°C and the opening temperature of the resistor fuses based on data from these tests. As is apparent from these results, good results can be obtained by using a finely divided conductive powder a melting temperature in the range from 60°C to 350°C dispersed in thermoplastic resin.

EXAMPLE 3

Figure 6:
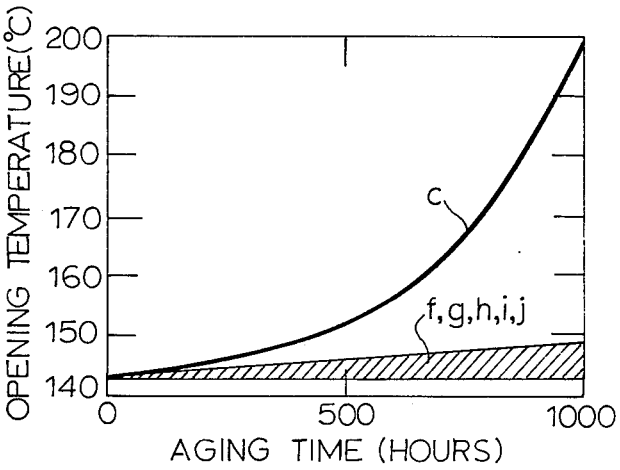
FIG. 6 is a graph illustrating the relation between the aging time and opening temperature of overtemperature and over current resistor fuses of the present invention.

Water-white rosin only and water-white rosin with stearic acid, behenic acid and glutamic hydrochloride as activators were used as an organic fluxing powder as shown in Table 4. These flux materials had particle sizes such that they passed through a 100 Mesh screen (about 147 microns). Epoxy resin (D.E.R. 664 only) was used as a binder. A mixture of 50 weight % of lead-tin cadmium eutectic powder (50 percent tin, 32 percent lead, 18 percent, cadmium), 40 weight % of silica powder, 1 to 10 weight % of said flux powder, and the balance epoxy resin was prepared in a manner similar to that of Example 2. The resultant resistor fuses (Type ¼ watt) had a nominal resistance value from $4.0\times10^{-2}\Omega$ to $8.0\times10^{-2}\ \Omega$ at room temperature. These resistors were subjected to tests similar to those of Example 2. FIG. 6 is a obtained graph illustrating the relation between the aging time at a temperature of 100°C and the opening temperature of resistor fuses based on the results of these tests. As is apparent from FIG. 6, good results can be obtained by using an organic flux powder dispersed in the thermoplastic resin of the resistor body.

EXAMPLE 4

Low density polyethylene, high density polyethylene, polypropylene, nylon and polystyrene were used as a resin for the resistor fuses as shown in Table 5. Low temperature alloys such as lead-tin-cadmium eutectic, lead-tin-bismuth non-eutectic and lead-tin eutectic were used as a conductive powder as listed in Table 6. The conductive powder used had a particle size such that it passed through a 300 Mesh Screen. Fifteen kinds of resistor fuses were prepared from these mixtures in a manner similar to that of Example 1. These resistor fuses were subjected to tests similar to those of Example 2. Table 7 shows the opening temperatures of the resistor fuses before aging and after aging (at a temperature of 120°C for a time period of 1000 hours). As is apparent from these results, it is possible to establish the opening temperatures of the resistor fuses by suitably selecting both the melting temperature of the crystalline high molecular weight resin and the melting temperature of conductive powder used. Better results can be obtained by using a crystalline high molecular weight resin having a melting temperature below the melting temperature of conductive powder used in the resistor body.

EXAMPLE 5

Eight kinds of resistor fuses were prepared in a manner similar to that of Example 1. Solder coated electrode leads were used which had various thermal conductivities of from 0.06 to 0.93 (eal/cm, sec. °C at 20°C). The kinds of electrode leads used were copper, aluminum, copper chromium alloy, copper clad iron, brass, iron and bronze as shown in Table 8.

Figure 7:
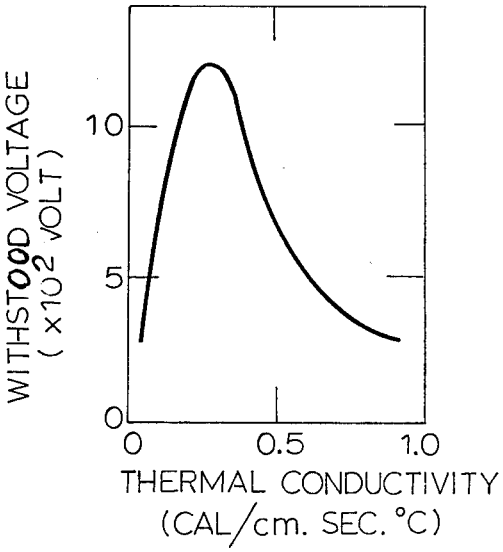
FIG. 7 is a graph illustrating the relation between the thermal conductivity of solder coated electrode leads and withstood voltage.

A mixture of 5 weight % of high density polyethylene powder, 5 weight % of water-white rosin with activators as flux powder (JS-64R; Trade name of Kooki Co., Japan) 20 weight % of silica powder, 69 weight % of the lead-tin-cadmium eutectic (32 percent lead, 50 percent tin, 18 percent cadmium) and the balance stearic acid was prepared for forming into a resistor body. Another mixture of 79 weight % of silica powder, 20 weight % of high density polyethylene powder, and 1 weight % stearic acid was prepared for a sleeve. The resultant resistor fuses (Type ¼ watt) had a nominal electrical resistance of $5.0\times10^{-2}\Omega$ at room temperature. These resistor fuses were examined with respect to their ability to withstand a voltage test after an overcurrent test. The voltage withstanding test was carried out in a manner similar to that described in ASTM D149-64. FIG. 7 is a graph illustrating the relation between the thermal conductivity of solder coated electrode leads and the withstood voltage based on data from the test. As is apparent from FIG. 7 better results can be obtained by using two solder coated electrode leads having a thermal conductivity of 0.1 to 0.4 cal/cm sec. °C.

EXAMPLE 6

Figure 9:
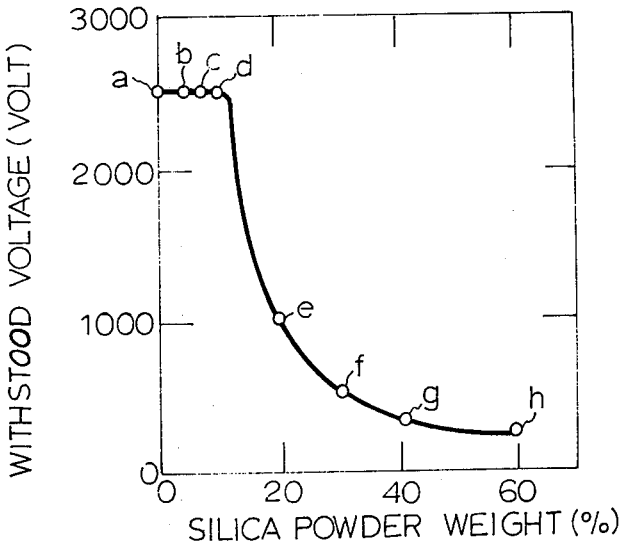
FIG. 9 is a graph illustrating the relation between silica powder weight (%) and the withstood voltage after opening temperature test.
Figure 8:
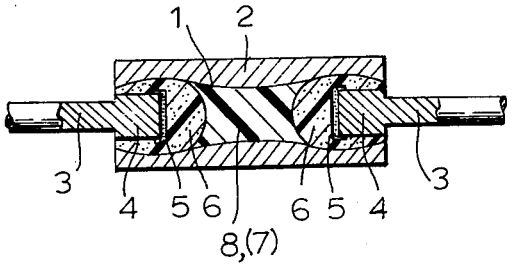
FIG. 8 is a cross sectional view of an overtemperature and overcurrent resistor fuse above the opening temperature of the resistor fuse having a composition of silica powder in the range from 0 to 10 weight (%).

Water-white rosin with activators was used as flux powder (JS-64R; Trade name of Kooki Co., Japan). The lead-tin eutectic (40 percent tin, 60 percent lead) used as a conducting powder had a melting temperature of 183°C. The silica powder used had an average particle size of 10 microns. Mixtures of eight kinds of compositions as shown in Table 9 were each prepared each for a resistor fuse body. Another mixture of 79 weight % of silica powder, 20 weight % of epoxy resin, 1 weight % of stearic acid was prepared for a sleeve in a manner similar to that of Example 1. The resultant resistor fuses (Type ¼ watt) had a nominal electrical resistance of $1.0 \times 10^{-2}\Omega$ at room temperature. These resistor fuses were subjected to a test similar to that in Example 5. FIG. 8 is a cross sectional view of an overtemperature and overcurrent resistor fuse which has been heated above the opening temperature of a resistor fuse having the composition is silica powder of the range from 0 to 10 weight %. FIG. 9 is a graph illustrating the relation between silica powder weight % and the withstood voltage after the opening temperature test. is apparent from these results, better results can be obtained by using an amount of silica powder in the range from 0 to 10 weight %.

Table 1

| | Conducting powder | Average Particle size | Melting Point (°C) |
|---|---|---|---|
| a | Acetylene black | 45 mμ | 400 or higher |
| b | Silver | 10 μ | 400 or higher |
| c | tin-lead eutectic | 74 μ or smaller | 183 |
| d | Tin | 74 μ or smaller | 232 |
| e | Bismuth | 74 μ or smaller | 272 |
| f | Lead | 74 μ or smaller | 327 |

Table 2

| | Phenol resin | Conducting Powder | Silica Powder | P-terphenyl powder | Stearic acid |
|---|---|---|---|---|---|
| a | 20 weight(%) | 20 weight (%) | 39 weight (%) | 20 weight (%) | 1 weight(%) |
| b | 10 | 30 | 59 | 0 | 1 |
| c | 10 | 50 | 39 | 0 | 1 |
| d | 10 | 50 | 39 | 0 | 1 |
| e | 9 | 90 | 0 | 0 | 1 |
| f | 10 | 50 | 39 | 0 | 1 |

Table 3

| | Kinds of resins | Trade name | manufacturer |
|---|---|---|---|
| a | Phenol resin | J-1000 | Matsushita Denko Co., |
| | Epoxy resin containing | DER.664 | Dow Chemical Co., |
| b | hardener | Diamino diphenyl sulfone | |
| c | Epoxy resin | DER.664 | Dow Chemical Co., |
| d | Epoxy resin | DER.669 | Dow chemical Co., |
| e | Polystylene | HF55 | Mitsubishi Monsanto Co., |

Table 4

| | Kinds of flux | Trade name | Manufacturer |
|---|---|---|---|
| c | Epoxy resin | DER 664 | Dow chemical Co., |
| f | Water-White rosin only | | Kooki Co., |
| g | Water-white rosin with activators | JS-64R | Kooki Co., |
| h | Stearic acid | | Kanto Chemical Co., |
| i | behenic acid | | Kanto Chemical Co., |
| j | glutamic hydrochloride | | Kanto Chemical Co., |

Table 5

| Kinds of resin | Trade name | Manufacturer | Melting Point |
|---|---|---|---|
| Polyethylene (Low density) | PS-30 | Mitsubishi Yuka Co., | 115°C |
| Polyethylene (High density) | 2100GP | Mitsui Petrochemical Co., | 129 |
| Polypropylene | JS-G | Mitsui chemical Co., | 164 |
| Nylon 12 | L-1801 | Daiseru Co., | 176 |
| Polystylene | HF-55 | Mitsubishi Monsanto Co., | — |

Table 6

| Kinds of Conductive powder | composition | | | manufacturer | Melting Point |
|---|---|---|---|---|---|
| Lead-tin-Cadmium eutectic | Sn 49.8 | Pb 32 | Cd 18.2 | Senju Metal Co, | 143°C |
| Lead-tin-Bismuth non-eutectic | Sn 43 | Pb 43 | Bi 14 | Senju Metal Co. | 165°C |
| Lead-tin-eutectic | Sn 62 | Pb 38 | | Eukuda Metal Co., | 183°C |

Table 7

| kinds of conductive powder / Kinds of resin | aging | Sn—Pb—Cd (143°c) initial | after aging | Sn—Pb—Bi (165°C) initial | after aging | Sn—Pb (183°C) initial | after aging |
|---|---|---|---|---|---|---|---|
| L.D. Polyethylene | (115°C) | 143.5 | 144 | 165 | 165.5 | 184 | 183 |
| H.D. Polyethylene | (129) | 144 | 144 | 165.5 | 163 | 183 | 183.5 |
| Polypropylene | (164) | 166 | 170 | 165 | 165.5 | 183.5 | 184 |
| Nylon 12 | (175) | 180 | 183 | 170 | 180 | 184 | 184.5 |
| Polystylene | (—) | 143.5 | 160 | 165 | 180 | 184 | 200 |

Table 8

| | Kinds of electrode leads | composition | Thermal conductivity at 20°C |
|---|---|---|---|
| a | Copper | | 0.93 cal/cm.sec.°C |
| b | Aluminum | | 0.53 |
| c | Copper-chromium alloy | | 0.40 |
| d | Copper clad iron | | 0.35 |
| e | Brass | Cu:67%, Zn:33% | 0.26 |
| f | Iron | | 0.17 |
| g | Bronze (1) | Cu:90%, Sn:10% | 0.10 |
| h | Bronze (2) | Cu:75%, Sn:25% | 0.06 |

Table 9

| | flux powder | silica powder | conductive powder | Opening Temperature |
|---|---|---|---|---|
| a | 20 weight (%) | 0 weight (%) | 80 weight (%) | 183°C |
| b | 10 | 5 | 85 | 183°C |
| c | 5 | 7 | 88 | 183°C |
| d | 18 | 10 | 72 | 183°C |
| e | 16 | 20 | 64 | 183°C |
| f | 14 | 30 | 56 | 183°C |
| g | 12 | 40 | 48 | 183°C |
| h | 8 | 60 | 32 | 183°C |

What we claim is:

1. An overtemperature and overcurrent resistor fuse comprising a resistor body consisting essentially of:

30 – 90% by weight finely divided conductive powder, said conductive powder consisting essentially of a fusible metal selected from the group consisting of tin, lead, cadmium, bismuth, indium and fusible alloys thereof;

1 – 20% by weight of an organic flux powder, said organic flux powder consisting essentially of an organic substance selected from the group consisting of and stearic acid, benic acid, glutamic hydrochloride, water-white rosin and water-white rosin with activators.

the balance by weight of a resin in which said powders are dispersed, said resin consisting essentially of a member selected from the group consisting of phenol resin, urea resin, melamine resin, epoxy resin, unsaturated polyester resin, polyethylene, polypropylene, polyvinylidene chloride, polystyrene, aerylonitrile-butadiene-styrene resin, butadiene-styrene, butyl rubber, ethylene-propylene rubber and mixtures thereof, said resistor body having an opening temperature above which particles of said conductive powder are aggregated due to melting into a plurality of separate bodies of aggregated conductive materials insulatively dispersed in said resin.

2. A resistor fuse as claimed in claim 1, wherein:

said resin consists essentially of a high density polyethylene;

said organic flux powder consists essentially of a water-white rosin with an activator;

said conductive powder consists essentially of a low-temperature solder containing bismuth, cadmium and indium; and further consisting of a silica powder in an amount up to 60% by weight dispersed in said resin.

3. A resistor fuse as claimed in claim 2 wherein said silica powder has an average particle size of 0.3 to 20 microns.

4. A resistor fuse as claimed in claim 1, wherein said conductive powder consists essentially of a lead-tin-cadmium eutectic.

5. A resistor fuse as claimed in claim 1, wherein said resin consists essentially of thermosetting and thermoplastic resin.

6. A resistor fuse as claimed in claim 1, wherein said resin consists essentially of high density polyethylene.

* * * * *